US011707944B2

(12) United States Patent
Lee et al.

(10) Patent No.: US 11,707,944 B2
(45) Date of Patent: Jul. 25, 2023

(54) SUBSTRATE TREATING APPARATUS AND INKJET APPARATUS

(71) Applicant: SEMES CO., LTD., Chungcheongnam-do (KR)

(72) Inventors: Jun Seok Lee, Chungcheongnam-do (KR); Yoon-Ok Jang, Chungcheongnam-do (KR); Sung Ho Kim, Chungcheongnam-do (KR); Kwang Jun Choi, Daejeon (KR); Hyun Min Lee, Gyeongsangnam-do (KR)

(73) Assignee: SEMES CO., LTD., Chungcheongnam-Do (KR)

( * ) Notice: Subject to any disclaimer, the term of this patent is extended or adjusted under 35 U.S.C. 154(b) by 0 days.

(21) Appl. No.: 17/407,936

(22) Filed: Aug. 20, 2021

(65) Prior Publication Data

US 2022/0055391 A1 Feb. 24, 2022

(30) Foreign Application Priority Data

Aug. 20, 2020 (KR) ..... 10-2020-0104300

(51) Int. Cl.
*B41M 1/34* (2006.01)
*B41J 2/165* (2006.01)
*B41M 7/00* (2006.01)

(52) U.S. Cl.
CPC ..... *B41M 7/0018* (2013.01); *B41M 1/34* (2013.01)

(58) Field of Classification Search
CPC ..... B41M 7/0018; B41J 11/0015; B41J 2002/16582; B41J 2002/1742; B41J 3/407
See application file for complete search history.

(56) References Cited

U.S. PATENT DOCUMENTS

2002/0054185 A1* 5/2002 Kinoshita ..... B41J 2/16526 347/35
2014/0313260 A1* 10/2014 Komatsu ..... B41J 11/0085 347/37

FOREIGN PATENT DOCUMENTS

| | | | |
|---|---|---|---|
| JP | 2006237482 | A | 9/2006 |
| JP | 2006-272544 | A | 10/2006 |
| JP | 2009-248337 | A | 10/2009 |
| JP | 2010-111059 | A | 5/2010 |
| JP | 2015196354 | A | 11/2015 |
| KR | 10-2005-0025367 | A | 3/2005 |
| KR | 10-2009-0000504 | A | 1/2009 |
| KR | 101166110 | B1 | 7/2012 |
| KR | 20160006351 | A * | 1/2016 |

OTHER PUBLICATIONS

Kim Ju Yong, MachineTranslationofKR-20160006351-A, 2016 (Year: 2016).*

* cited by examiner

*Primary Examiner* — Scott A Richmond
(74) *Attorney, Agent, or Firm* — Procopio, Cory, Hargreaves & Savitch LLP

(57) ABSTRACT

Disclosed is a substrate treating apparatus. The substrate treating apparatus may include a stage including an accommodation area, onto or from which a substrate is loaded or unloaded, and a treatment area, in which the substrate is treated, a liquid discharge head that supplies a treatment liquid to the substrate, and a liquid receiving part that receives the treatment liquid pre-discharged by the liquid discharge head in the treatment area.

17 Claims, 7 Drawing Sheets

SUBSTRATE TREATING APPARATUS AND INKJET APPARATUS

CROSS-REFERENCE TO RELATED APPLICATIONS

A claim for priority under 35 U.S.C. § 119 is made to Korean Patent Application No. 10-2020-0104300 filed on Aug. 20, 2020, in the Korean Intellectual Property Office, the entire contents of which are hereby incorporated by reference.

BACKGROUND

Embodiments of the inventive concept described herein relate to a substrate treating apparatus and an inkjet apparatus.

In general, an inkjet method of ejecting liquid ink to a surface of a medium is used for a substrate treating process in the field of a semiconductor or a display as well as in the field of printing a document or a flier. In the substrate treating process in the field of a semiconductor/display that uses the inkjet method, a pattern of a complex shape is formed on a substrate (for example, glass) by discharging ink droplets to a specific location on the substrate.

As illustrated in FIG. 1, the inkjet apparatus 10 used in the field of a semiconductor or a display includes a stage 12 and an inkjet head 14. When glass "G" is seated on the stage 12, the stage 12 floats the glass "G" by ejecting air "A" to a lower surface of the glass "G". The floated glass "G" is gripped by a gripper or the like, and the inkjet head 14 is transferred to an area, to which ink is discharged. The inkjet head 14 prints inks (for example, "R", "G", and "B") of different kinds to an upper surface of the glass "G".

In order to discharge an accurate amount of ink to the glass "G", it is important to maintain a condition of the inkjet head 14. One of the most preferable measures of maintaining the condition of the inkjet head 14 is to allow the inkjet head 14 to continuously discharge the ink. This is because the flows of the ink in the inkjet head 14 are not smooth when the ink is hardened.

In general, in order to maintain the condition of the inkjet head 14, the inkjet head 14 performs pre-jetting. The pre-jetting is performed in a separate maintenance space instead of an area, in which the glass "G" is treated. That is, the inkjet head 14 may maintain the condition through the pre jetting and by discharging the ink to the glass "G".

However, in pixel printing of discharging inks of different kinds, among nozzles of the inkjet head 14, a nozzle may not be used. This is because, in the pixel printing, a volume in a final pixel is adjusted through combination of necessary nozzles of the inkjet head 14. In this way, when there is a nozzle that does not participate in printing, the corresponding nozzle may be a cause of generating an abnormal striking point in next printing.

SUMMARY

Embodiments of the inventive concept provide a substrate treating apparatus that may efficiently treat a substrate, and an inkjet apparatus.

Embodiments of the inventive concept provide a substrate treating apparatus that may effectively maintain a condition of a liquid discharge head, and an inkjet apparatus.

Embodiments of the inventive concept provide a substrate treating apparatus that may minimize hardening of a treatment liquid in a liquid discharge head by allowing a nozzle that does not participate in treatment of a substrate to pre-discharge the treatment liquid while the substrate is treated, and an inkjet apparatus The aspect of the inventive concept is not limited thereto, and other unmentioned aspects of the present invention may be clearly appreciated by those skilled in the art from the following descriptions.

The inventive concept provides a substrate treating apparatus. The substrate treating apparatus may include a stage including an accommodation area, onto or from which a substrate is loaded or unloaded, and a treatment area, in which the substrate is treated, a liquid discharge head that supplies a treatment liquid to the substrate, and a liquid receiving part that receives the treatment liquid pre-discharged by the liquid discharge head in the treatment area.

According to an embodiment, the substrate treating apparatus may further include a carrier that transfers the substrate between the accommodation area and the treatment area, and the carrier may include a support part that supports the liquid receiving part and the substrate.

According to an embodiment, a vacuum-absorption line that vacuum-absorbs the substrate supported by the support part may be connected to the support part.

According to an embodiment, the liquid receiving part may be provided on a front side of the support part.

According to an embodiment, the liquid receiving part may have an open-topped vessel shape.

According to an embodiment, the substrate treating apparatus may further include a transfer unit that transfers the substrate and the liquid receiving part between the accommodation area and the treatment area.

According to an embodiment, the liquid receiving part may be provided on a front side of the support part to be transferred.

According to an embodiment, the transfer unit may transfer the substrate and the liquid receiving part in a floated state, by ejecting air to lower surfaces of the substrate and the liquid receiving part.

According to an embodiment, the liquid receiving part may be installed in the treatment area of the stage.

According to an embodiment, the liquid receiving part may be inserted into and installed in a recess that is recessed downwards from an upper surface of the stage.

According to an embodiment, the liquid receiving part may be located to overlap an area, to which the liquid discharge head discharges the treatment liquid, when viewed from a top.

According to an embodiment, the substrate treating apparatus may further include a controller, and the controller may control the liquid discharge head to pre-discharge the treatment liquid to the liquid receiving part and control the liquid discharge head to discharge the treatment liquid to the substrate.

According to an embodiment, the treatment liquid may include a plurality of kinds of inks having different colors.

The inventive concept provides a substrate treating apparatus. The substrate treating apparatus may include a stage that supports a substrate and transfer the substrate, a liquid discharge head that supplies a treatment liquid including a plurality of kinds of inks having different colors to the substrate, and a liquid receiving part that receives the treatment liquid pre-discharged by the liquid discharge head while moving together with the stage.

According to an embodiment, the liquid receiving part may have an open-topped vessel shape.

According to an embodiment, the liquid receiving part may be provided on a front side of the support part to move.

According to an embodiment, the substrate treating apparatus may further include a controller, and the controller may control the liquid discharge head to pre-discharge the treatment liquid to the liquid receiving part, and control the liquid discharge head to discharge the treatment liquid to the substrate.

The inventive concept provides an inkjet apparatus for printing inks of different kinds on a glass substrate. The inkjet apparatus may include a stage including an accommodation area, onto or from which the glass substrate is loaded or unloaded, and a treatment area, in which the glass substrate is treated, a liquid discharge head that discharges the inks onto the glass substrate, and a liquid receiving part that receives the inks pre-discharged by the liquid discharge head in the treatment area.

According to an embodiment, the inkjet apparatus may further include a plate-shaped carrier that carries the glass substrate between the accommodation area and the treatment area, and the carrier may include a support part that supports the liquid receiving part and the glass substrate.

According to an embodiment, the inkjet apparatus may further include a controller, and the controller may control the liquid discharge head to pre-discharge the inks to the liquid receiving part, and then control the liquid discharge head to discharge the inks to the glass substrate

BRIEF DESCRIPTION OF THE FIGURES

The above and other objects and features will become apparent from the following description with reference to the following figures, wherein like reference numerals refer to like parts throughout the various figures unless otherwise specified, and wherein.

DETAILED DESCRIPTION

Figure 1:
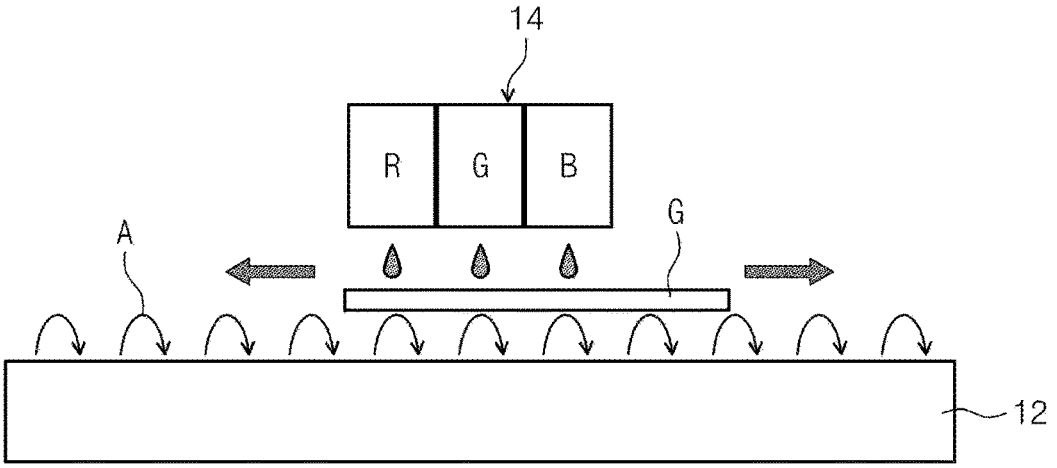
FIG. 1 is a view illustrating a general inkjet apparatus.

Hereinafter, exemplary embodiments of the inventive concept will be described in detail with reference to the accompanying drawings so that those skilled in the art to which the inventive concept pertains may easily carry out the inventive concept. However, the inventive concept may be implemented in various different forms, and is not limited to the embodiments. Furthermore, in a description of the embodiments of the inventive concept, a detailed description of related known functions or configurations will be omitted when they make the essence of the inventive concept unnecessarily unclear. In addition, the same reference numerals are used for parts that perform similar functions and operations throughout the drawings.

The expression of 'including' some elements may mean that another element may be further included without being excluded unless there is a particularly contradictory description. In detail, the terms "including" and "having" are used to designate that the features, the numbers, the steps, the operations, the elements, the parts, or combination thereof described in the specification are present, and may be understood that one or more other features, numbers, step, operations, elements, parts, or combinations thereof may be added.

The terms of a singular form may include plural forms unless otherwise specified. Furthermore, in the drawings, the shapes and sizes of the elements may be exaggerated for clearer description.

Hereinafter, embodiments of the inventive concept will be described with reference to FIGS. 2 to 13. Furthermore, hereinafter, it will be described as an example that a substrate "G" is a glass substrate. Furthermore, hereinafter, it will be described as an example that a substrate treating apparatus 100, 200, 300, and 400 performs pixel printing. Furthermore, hereinafter, it will be described as an example that the substrate treating apparatus 100, 200, 300, and 400 is an inkjet apparatus that prints inks (for example, "R", "G", and "B") of different kinds on the glass substrate "G". Furthermore, hereinafter, it will be described as an example that treatment liquid discharged by a liquid discharge head 120, 220, 320, and 420 is an ink.

First Embodiment

Figure 2:
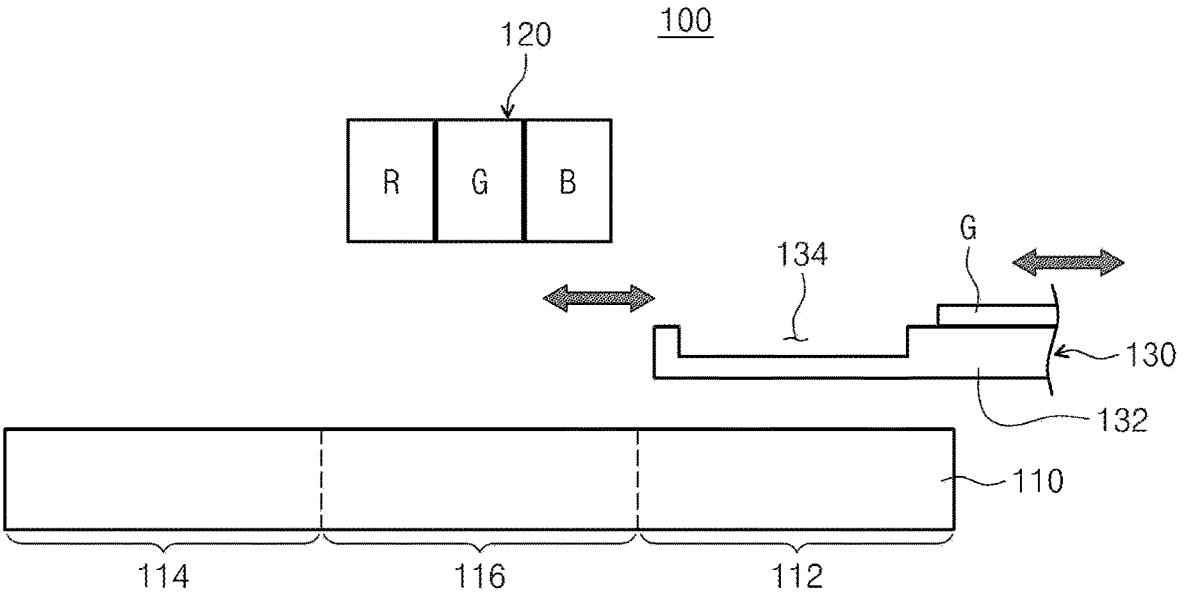
FIG. 2 is a view illustrating a substrate treating apparatus according to a first embodiment of the inventive concept.

FIG. 2 is a view illustrating a substrate treating apparatus according to a first embodiment of the inventive concept. Referring to FIG. 2, the substrate treating apparatus 100 according to the embodiment of the inventive concept may include a stage 110, a liquid discharge head 120, a carrier 130, and a controller (not illustrated).

The stage 110 may include accommodation areas 112 and 114 and a treatment area 116. The accommodation areas 112 and 114 may be areas, onto or from which the substrate "G" is loaded or unloaded. The accommodation areas 112 and 114 may be a loading area 112 and an unloading area 114. The treatment area 116 may be an area, in which the substrate "G" is treated. The treatment area 116 may be an area, in which the liquid discharge head 120 supplies a treatment liquid "I".

The liquid discharge head 120 may supply the treatment liquid "I" to the substrate "G". The liquid discharge head 120 may include a plurality of nozzles that discharge the treatment liquid "I". The liquid discharge head 120 may be an inkjet head. The liquid discharge head 120 may discharge the treatment liquid "I" to the substrate "G" while reciprocating in a direction that is perpendicular to a transfer direction of the substrate "G" when viewed from a top.

The carrier 130 may have a plate shape. The carrier 130 may transfer the substrate "G" between the accommodation areas 112 and 114, and the treatment 116. The carrier 130 may include a liquid receiving part 134 that receives the treatment liquid "I" pre-discharged by the liquid discharge head 120 in the treatment area 116, and a support part 132 that supports the substrate "G". The liquid receiving part 134 may have a recess shape that is recessed downwards from an upper surface of the carrier 130 when viewed from the top. Furthermore, the liquid receiving part 134 may be provided on a front side of the support part 132. Furthermore, a vacuum-absorption line (not illustrated) that vacuum-absorbs the supported substrate "G" may be connected to the support part 132 to improve warpage of the substrate "G".

Furthermore, the carrier 130 may be transferred in an air floating manner, or one side and/or an opposite side of the carrier 130 may be gripped by a gripper such that the carrier 130 is transferred.

Figure 3:
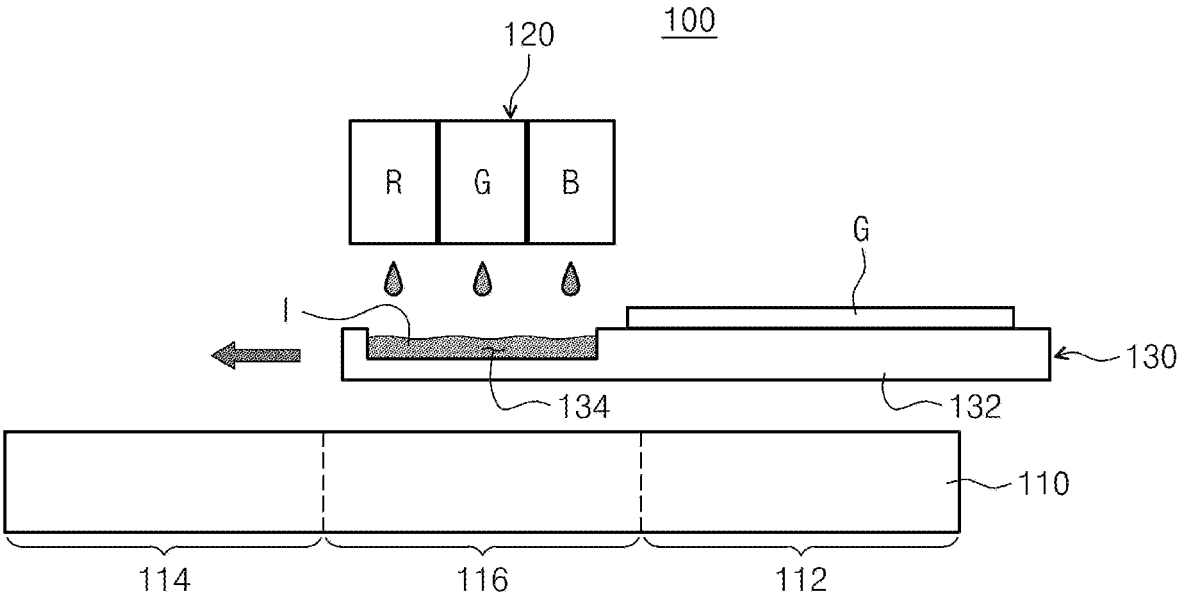
FIG. 3 is a view illustrating a state, in which a liquid discharge head of FIG. 2 pre-discharges a treatment liquid.
Figure 4:
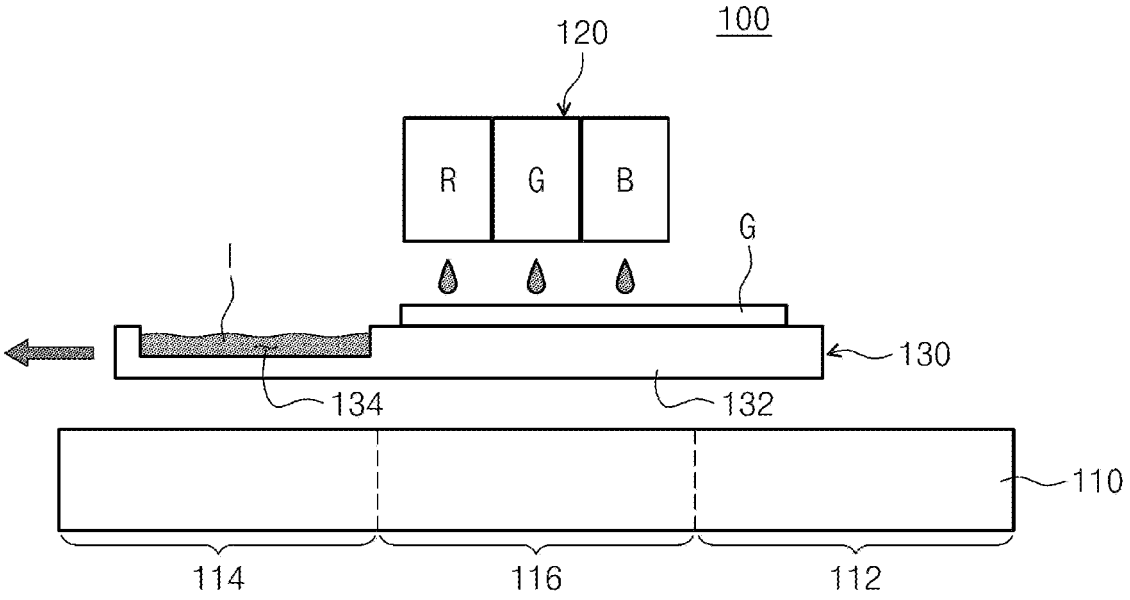
FIG. 4 is a view illustrating a state, in which the liquid discharge head of FIG. 2 supplies the treatment liquid to a substrate.

FIG. 3 is a view illustrating a state, in which a liquid discharge head of FIG. 2 pre-discharges a treatment liquid. FIG. 4 is a view illustrating a state, in which the liquid discharge head of FIG. 2 supplies the treatment liquid to a substrate. Referring to FIGS. 3 and 4, the controller (not illustrated) may control the substrate treating apparatus 100. The controller may control the liquid discharge head 120 to pre-discharge the treatment liquid "I" to the liquid receiving part 134 and then discharge the treatment liquid "I" to the substrate "G". Because the liquid discharge head 120 may pre-discharge the treatment liquid "I" in the treatment area 116, a condition of the liquid discharge head 120 may be effectively maintained.

Second Embodiment

Figure 5:
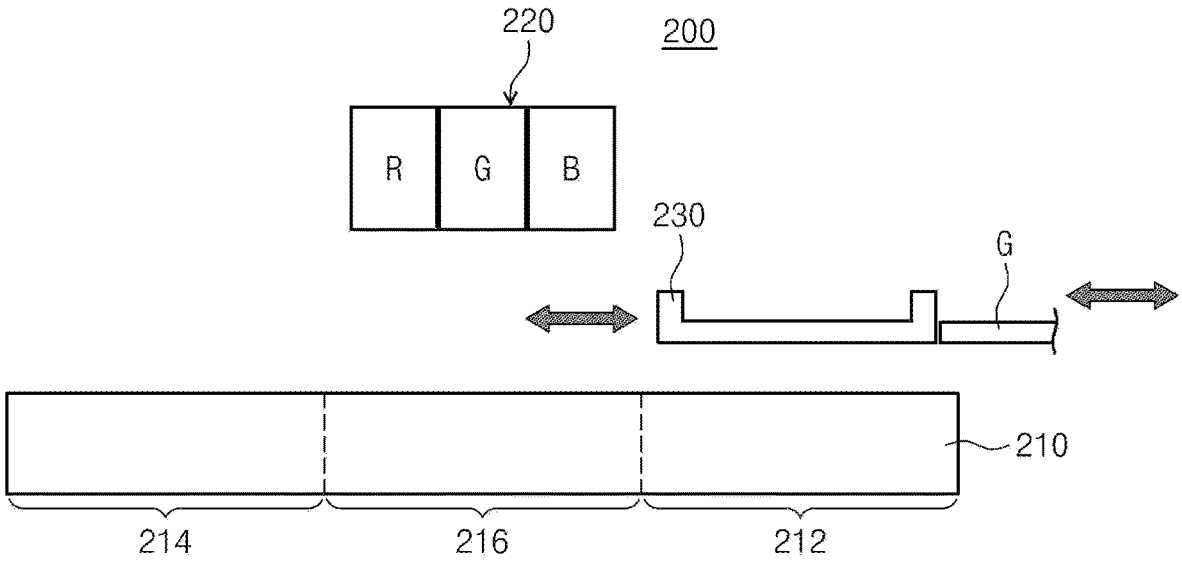
FIG. 5 is a view illustrating a substrate treating apparatus according to a second embodiment of the inventive concept.

FIG. 5 is a view illustrating a substrate treating apparatus according to a second embodiment of the inventive concept. Referring to FIG. 5, the substrate treating apparatus 200 according to the embodiment of the inventive concept may include a stage 210, a liquid discharge head 220, and a liquid receiving part 230.

Because the stage 210 and the liquid discharge head 220 are the same as or similar to the stage 110 and the liquid discharge head 120, which have been described above, a repeated description thereof will be omitted.

The liquid receiving part 230 may have an open-topped vessel shape. The liquid receiving part 230 and the substrate "G" may be transferred by a transfer unit (not illustrated) that transfers the substrate "G" and the liquid receiving part 230, between accommodation areas 212 and 214 and a treatment area 216. The transfer unit may transfer the substrate "G" and the liquid receiving part 230 in a floated state, by ejecting air to lower surfaces of the substrate "G" and the liquid receiving part 230. Unlike this, the transfer unit may grip one side and/or an opposite side of the substrate "G" and the liquid receiving part 230 by using a gripper or the like to transfer the substrate "G" and the liquid receiving part 230. Then, the liquid receiving part 230 may be located on a front side of the substrate "G" to be transferred.

Figure 6:
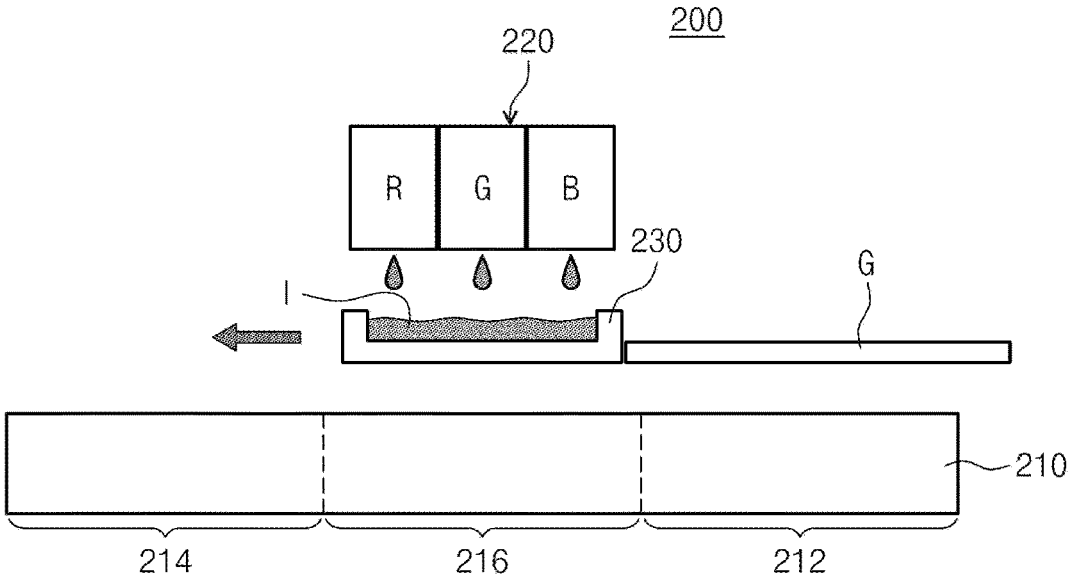
FIG. 6 is a view illustrating a state, in which a liquid discharge head of FIG. 5 pre-discharges a treatment liquid.
Figure 7:
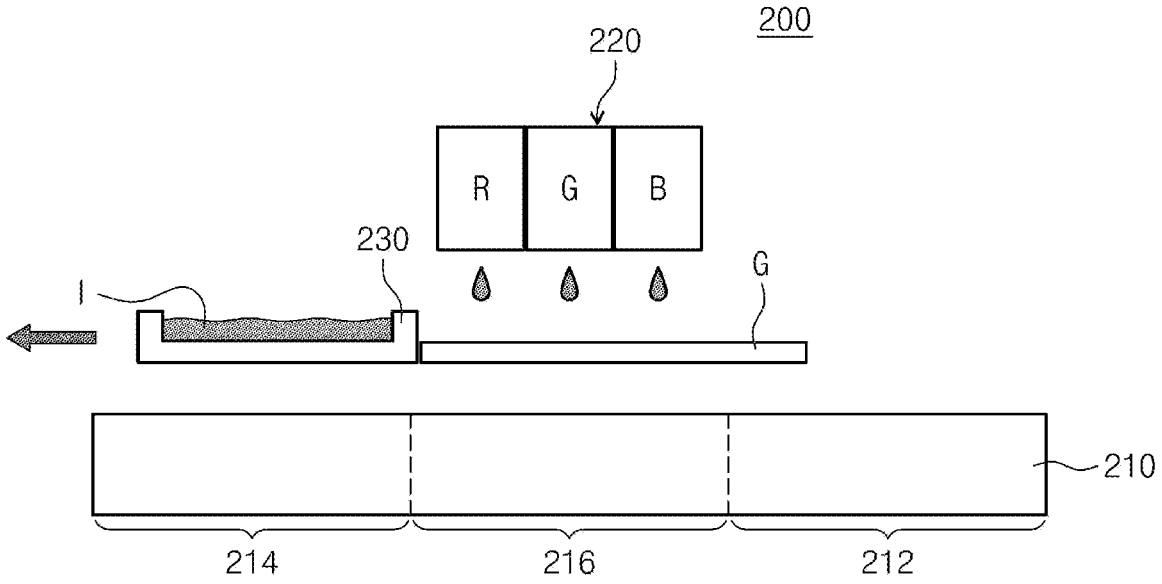
FIG. 7 is a view illustrating a state, in which the liquid discharge head of FIG. 5 supplies the treatment liquid to a substrate.

FIG. 6 is a view illustrating a state, in which a liquid discharge head of FIG. 5 pre-discharges a treatment liquid. FIG. 7 is a view illustrating a state, in which the liquid discharge head of FIG. 5 supplies the treatment liquid to a substrate. Referring to FIGS. 6 and 7, the controller (not illustrated) may control the substrate treating apparatus 200. The controller may control the liquid discharge head 220 to pre-discharge the treatment liquid "I" to the liquid receiving part 230 and then discharge the treatment liquid "I" to the substrate "G". Because the liquid discharge head 220 may pre-discharge the treatment liquid "I" in the treatment area 216, a condition of the liquid discharge head 220 may be effectively maintained.

Third Embodiment

Figure 8:
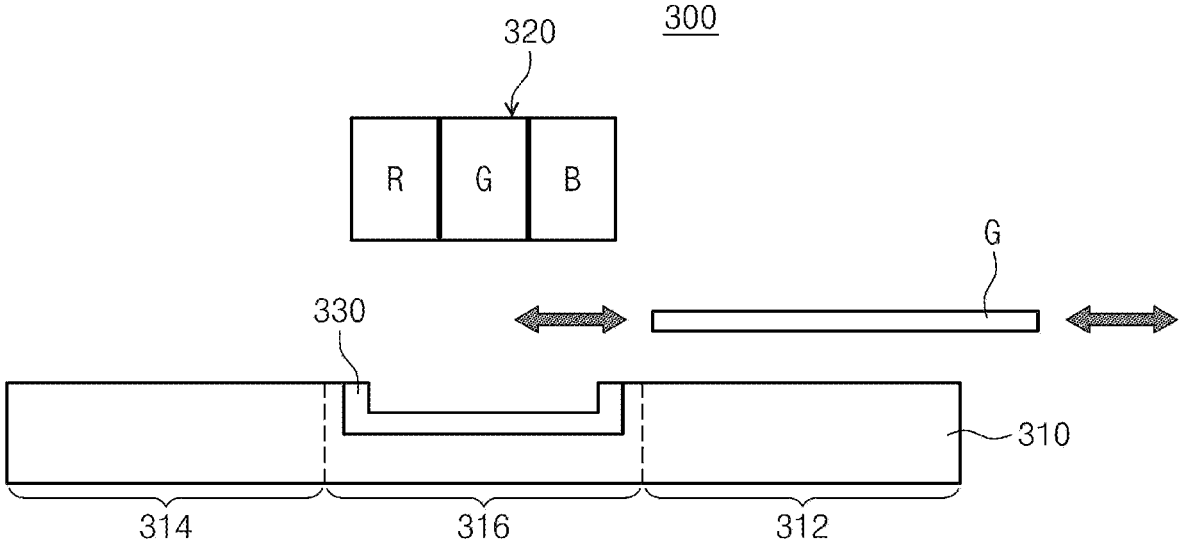
FIG. 8 is a view illustrating a substrate treating apparatus according to a third embodiment of the inventive concept.

FIG. 8 is a view illustrating a substrate treating apparatus according to a third embodiment of the inventive concept. Referring to FIG. 8, the substrate treating apparatus 300 according to the embodiment of the inventive concept may include a stage 310, a liquid discharge head 320, and a liquid receiving part 330.

Because the liquid discharge head 320 is the same as or similar to the liquid discharge head 120, a repeated description thereof will be omitted.

The liquid receiving part 330 may have an open-topped vessel shape. The liquid receiving part 330 may be installed in the stage 310. For example, the liquid receiving part 330 may be inserted into and installed in a recess that is recessed downwards from an upper surface of the stage 310. Furthermore, the liquid receiving part 330 may be installed in the treatment area 316 of the stage 310. Furthermore, the liquid receiving part 330 may be located to overlap an area, to which the liquid discharge head 320 discharges the treatment liquid "I", when viewed from the top.

The substrate "G" may be transferred between accommodation areas 312 and 314 and a treatment area 316 by the transfer unit (not illustrated). The transfer unit may grip one side and/or an opposite side of the substrate "G" by using a gripper or the like to transfer the substrate "G".

Figure 9:
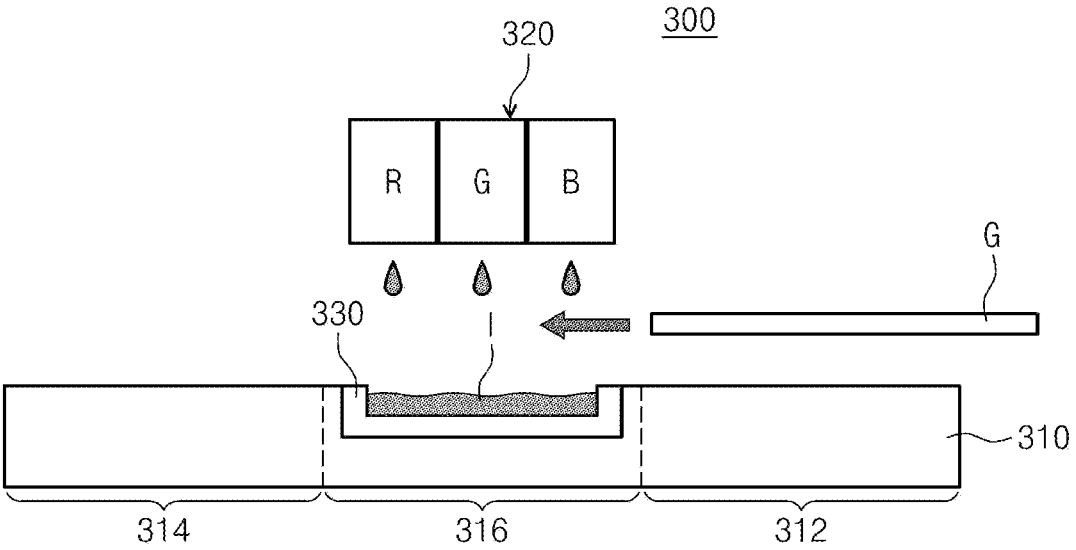
FIG. 9 is a view illustrating a state, in which a liquid discharge head of FIG. 8 pre-discharges a treatment liquid.
Figure 10:
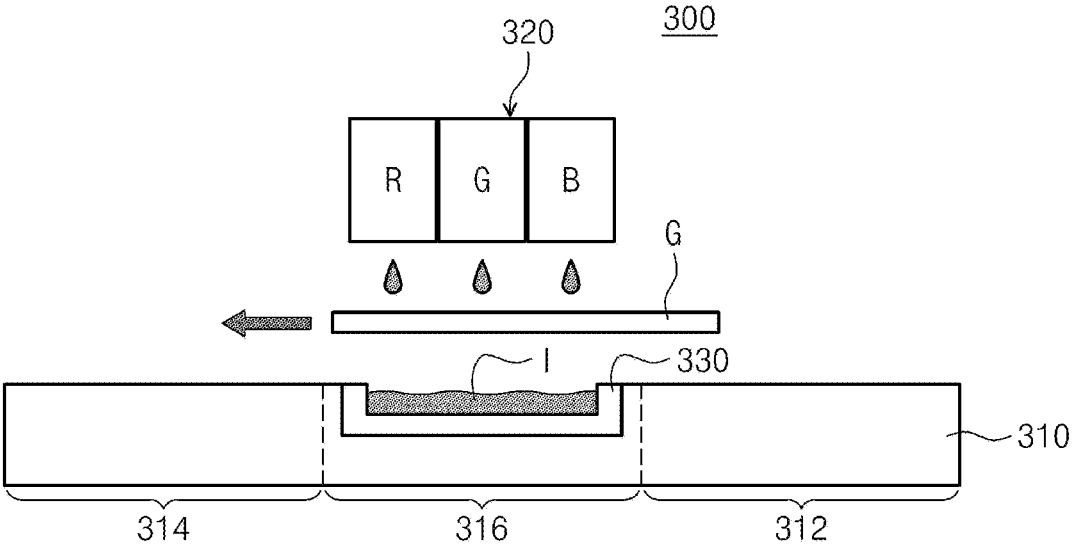
FIG. 10 is a view illustrating a state, in which the liquid discharge head of FIG. 8 supplies the treatment liquid to a substrate.

FIG. 9 is a view illustrating a state, in which a liquid discharge head of FIG. 8 pre-discharges a treatment liquid. FIG. 10 is a view illustrating a state, in which the liquid discharge head of FIG. 8 supplies the treatment liquid to a substrate. Referring to FIGS. 9 and 10, the controller (not illustrated) may control the substrate treating apparatus 300. The controller may control the liquid discharge head 320 to pre-discharge the treatment liquid "I" to the liquid receiving part 330 and then discharge the treatment liquid "I" to the substrate "G". Because the liquid discharge head 320 may pre-discharge the treatment liquid "I" in the treatment area 316, a condition of the liquid discharge head 320 may be effectively maintained.

Fourth Embodiment

Figure 11:
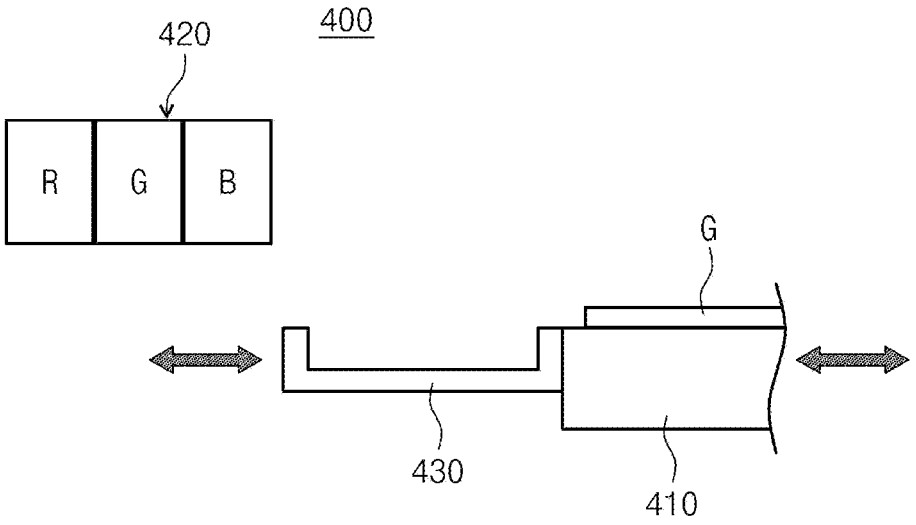
FIG. 11 is a view illustrating a substrate treating apparatus according to a fourth embodiment of the inventive concept.

FIG. 11 is a view illustrating a substrate treating apparatus according to a fourth embodiment of the inventive concept. Referring to FIG. 11, the substrate treating apparatus 400 according to the embodiment of the inventive concept may include a stage 410, a liquid discharge head 420, and a liquid receiving part 430.

Because the liquid discharge head 420 is the same as or similar to the liquid discharge head 120, a repeated description thereof will be omitted.

The stage 410 may support the substrate "G". The stage 410 may transfer the substrate "G". The stage 410 may transfer the substrate "G" to an area, to which the liquid discharge head 420 discharges the treatment liquid "I".

The liquid receiving part 430 may have an open-topped vessel shape. The liquid receiving part 430 may move together with the stage 410. For example, the liquid receiving part 430 may be coupled to the stage 410 to move together with the stage 410. Furthermore, the liquid receiving part 430 may be located on a front side of the stage 410 to move.

Figure 12:
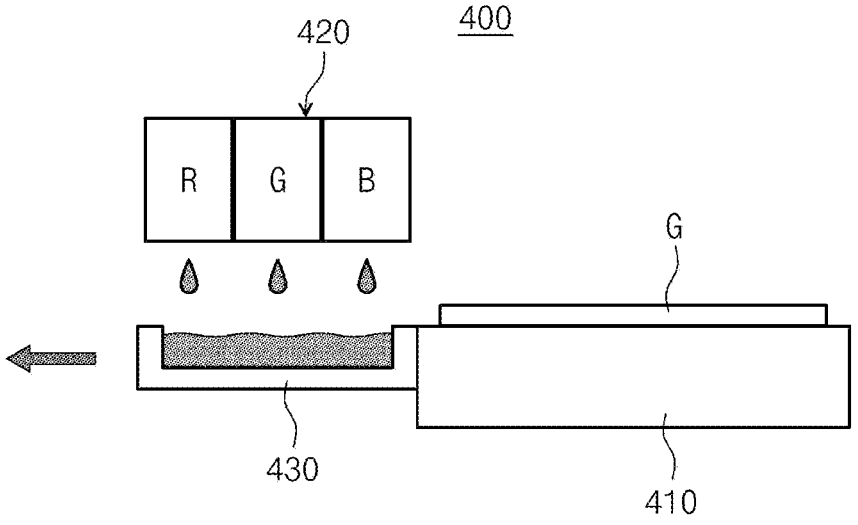
FIG. 12 is a view illustrating a state, in which a liquid discharge head of FIG. 11 pre-discharges a treatment liquid.
Figure 13:
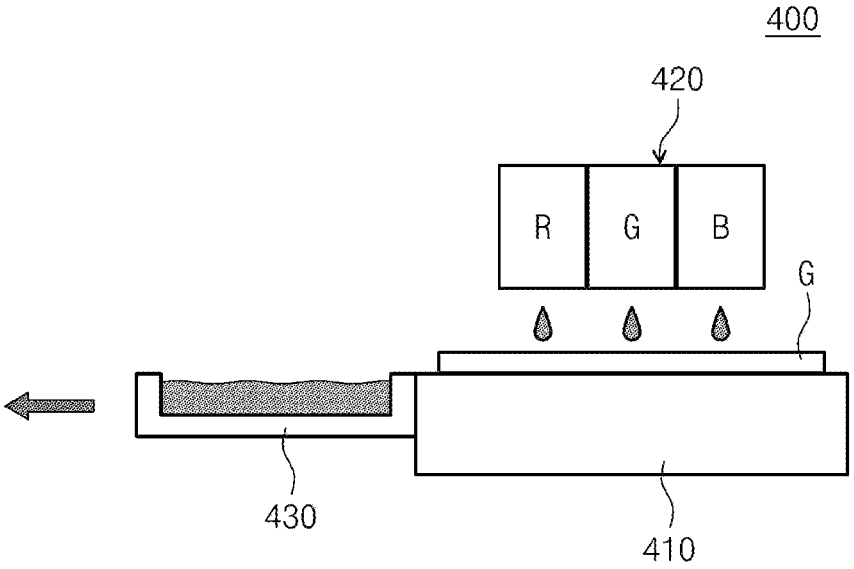
FIG. 13 is a view illustrating a state, in which the liquid discharge head of FIG. 11 supplies the treatment liquid to a substrate.

FIG. 12 is a view illustrating a state, in which a liquid discharge head of FIG. 11 pre-discharges a treatment liquid. FIG. 13 is a view illustrating a state, in which the liquid discharge head of FIG. 11 supplies the treatment liquid to a substrate. Referring to FIGS. 12 and 13, the controller (not illustrated) may control the substrate treating apparatus 400. The controller may control the liquid discharge head 420 to pre-discharge the treatment liquid "I" to the liquid receiving part 430 and then discharge the treatment liquid "I" to the substrate "G". Because the liquid discharge head 420 may pre-discharge the treatment liquid "I" shortly before the treatment liquid "I" is supplied to the substrate "G", a condition of the liquid discharge head 420 may be effectively maintained.

According to an embodiment of the inventive concept, the substrate may be efficiently treated.

Furthermore, according to an embodiment of the inventive concept, the condition of the liquid discharge head may be effectively maintained.

Furthermore, according to an embodiment of the inventive concept, hardening of a treatment liquid in a liquid discharge head may be minimized by allowing a nozzle that does not participate in treatment of a substrate to pre-discharge the treatment liquid while the substrate is treated.

The effects of the inventive concept are not limited to the above-mentioned effects, and the unmentioned effects can be clearly understood by those skilled in the art to which the inventive concept pertains from the specification and the accompanying drawings.

The above detailed description exemplifies the inventive concept. Furthermore, the above-mentioned contents describe the exemplary embodiment of the inventive concept, and the inventive concept may be used in various other combinations, changes, and environments. That is, the inventive concept can be modified and corrected without departing from the scope of the inventive concept that is disclosed in the specification, the equivalent scope to the written disclosures, and/or the technical or knowledge range of those skilled in the art. The written embodiment describes the best state for implementing the technical spirit of the inventive concept, and various changes required in the detailed application fields and purposes of the inventive concept can be made. Accordingly, the detailed description of the inventive concept is not intended to restrict the inventive concept in the disclosed embodiment state. Furthermore, it should be construed that the attached claims include other embodiments.

What is claimed is:

1. A substrate treating apparatus comprising:

a stage including a first accommodation area, onto or from which a substrate is loaded or unloaded, a treatment area, in which the substrate is treated, and a second accommodation area disposed on an opposing side of the treatment area with respect to the first accommodation area;

a liquid discharge head configured to supply a treatment liquid to the substrate; and a liquid receiving part configured to receive the treatment liquid pre-discharged by the liquid discharge head in the treatment area when the liquid receiving part moves from the second accommodation area to the treatment area, and the substrate moves from the treatment area to the first accommodation area.

2. The substrate treating apparatus of claim 1, further comprising:

a carrier configured to transfer the substrate between the first accommodation area and the treatment area, and wherein the carrier includes:

a support part configured to support the liquid receiving part and the substrate.

3. The substrate treating apparatus of claim 2, wherein a vacuum-absorption line configured to vacuum-absorb the substrate supported by the support part is connected to the support part.

4. The substrate treating apparatus of claim 2, wherein the liquid receiving part is provided on a front side of the support part.

5. The substrate treating apparatus of claim 1, wherein the liquid receiving part has an open-topped vessel shape.

6. The substrate treating apparatus of claim 5, further comprising:

a transfer unit configured to transfer the substrate and the liquid receiving part between the first accommodation area, the second accommodation area and the treatment area.

7. The substrate treating apparatus of claim 6, wherein the liquid receiving part is provided on a front side of a support part configured to support the liquid receiving part and the substrate.

8. The substrate treating apparatus of claim 5, wherein the liquid receiving part is installed in the treatment area of the stage.

9. The substrate treating apparatus of claim 8, wherein the liquid receiving part is inserted into and installed in a recess that is recessed downwards from an upper surface of the stage.

10. The substrate treating apparatus of claim 8, wherein the liquid receiving part is located to overlap an area, to which the liquid discharge head discharges the treatment liquid, when viewed from a top.

11. The substrate treating apparatus of claim 1, further comprising:

a controller, wherein the controller controls the liquid discharge head to pre-discharge the treatment liquid to the liquid receiving part, and controls the liquid discharge head to discharge the treatment liquid to the substrate.

12. The substrate treating apparatus of claim 1, wherein the treatment liquid includes a plurality of kinds of inks having different colors.

13. A substrate treating apparatus comprising:

a stage including an accommodation area, onto or from which a substrate is loaded or unloaded, and a treatment area, in which the substrate is treated;

a liquid discharge head configured to supply a treatment liquid to the substrate;

a liquid receiving part configured to receive the treatment liquid pre-discharged by the liquid discharge head in the treatment area; and a transfer unit configured to transfer the substrate and the liquid receiving part between the accommodation area and the treatment area, wherein the transfer unit transfers the substrate and the liquid receiving part in a floated state, by ejecting air to lower surfaces of the substrate and the liquid receiving part.

14. A substrate treating apparatus comprising:

a stage configured to support a substrate and transfer the substrate, the stage including a first accommodation area, a treatment area, and a second accommodation area disposed on an opposing side of the treatment area with respect to the first accommodation area;

a liquid discharge head configured to supply a treatment liquid including a plurality of kinds of inks having different colors to the substrate; and a liquid receiving part configured to receive the treatment liquid pre-discharged by the liquid discharge head while moving together with the stage when the liquid receiving part moves from the second accommodation area to the treatment area, and the substrate moves from the treatment area to the first accommodation area.

15. The substrate treating apparatus of claim 14, wherein the liquid receiving part has an open-topped vessel shape.

16. The substrate treating apparatus of claim 15, wherein the liquid receiving part is provided on a front side of the support part configured to support the liquid receiving part and the substrate.

17. The substrate treating apparatus of claim 14, further comprising:

a controller, wherein the controller controls the liquid discharge head to pre-discharge the treatment liquid to the liquid receiving part, and controls the liquid discharge head to discharge the treatment liquid to the substrate.

* * * * *